US008469120B2

(12) United States Patent
Entchev et al.

(10) Patent No.: US 8,469,120 B2
(45) Date of Patent: Jun. 25, 2013

(54) METHODS AND APPARATUS FOR CONTROLLING CUTTING RIBBONS DURING A DRILLING OPERATION

(75) Inventors: Pavlin B. Entchev, Houston, TX (US); John H. Jackson, Idaho Falls, ID (US); John K. Montgomery, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 338 days.

(21) Appl. No.: 12/594,314

(22) PCT Filed: Apr. 21, 2008

(86) PCT No.: PCT/US2008/005081

§ 371 (c)(1),
(2), (4) Date: Oct. 1, 2009

(87) PCT Pub. No.: WO2008/156520

PCT Pub. Date: Dec. 24, 2008

(65) Prior Publication Data

US 2010/0126771 A1 May 27, 2010

Related U.S. Application Data

(60) Provisional application No. 60/934,324, filed on Jun. 13, 2007.

(51) Int. Cl.
*E21B 10/36* (2006.01)

(52) U.S. Cl.
USPC ..... 175/393; 175/57; 175/381; 175/384

(58) Field of Classification Search
USPC ..... 175/57, 393, 381, 384
See application file for complete search history.

(56) References Cited

U.S. PATENT DOCUMENTS

| | | | | |
|---|---|---|---|---|
| 2,654,578 | A | 10/1953 | Pearce | |
| 4,373,592 | A * | 2/1983 | Dellinger et al. | 175/61 |
| 4,606,418 | A | 8/1986 | Thompson | |
| 4,852,671 | A | 8/1989 | Southland | |
| 4,883,132 | A | 11/1989 | Tibbitts | |

(Continued)

FOREIGN PATENT DOCUMENTS

| | | |
|---|---|---|
| GB | 2 085 945 | 5/1982 |
| GB | 2 361 018 | 10/2001 |
| WO | WO 01/00961 | 1/2001 |

OTHER PUBLICATIONS

*European Search Report*, dated Dec. 21, 2007, RS 115653 US.

(Continued)

*Primary Examiner* — Giovanna Wright
(74) *Attorney, Agent, or Firm* — ExxonMobil Upstream Research Company—Law Department

(57) ABSTRACT

Drill bits are provided. The drill bits are of the fixed-cutter, rotary-type. The drill bits have a plurality of blades having cutting elements disposed therealong. Junk slots are formed between the respective blades. A knife opening is formed in at least two of the junk slots. Preferably, the knife openings are disposed substantially transverse to a longitudinal axis of the drill bit. The drill bit also has one or more ribbon cutters. The ribbon cutters cyclically protrude through knife openings in the junk slots in order to facilitate the fragmentation of cuttings ribbons moving through the junk slots during a drilling operation.

44 Claims, 5 Drawing Sheets

U.S. PATENT DOCUMENTS

| | | | | |
|---|---|---|---|---|
| 4,913,244 | A | | 4/1990 | Trujillo |
| 4,984,642 | A | | 1/1991 | Renard et al. |
| 4,984,643 | A | | 1/1991 | Isbell et al. |
| 5,115,873 | A | | 5/1992 | Pastusek |
| 5,172,778 | A | | 12/1992 | Tibbitts et al. |
| 5,323,865 | A | | 6/1994 | Isbell et al. |
| 5,447,208 | A | | 9/1995 | Lund et al. |
| 5,553,678 | A | * | 9/1996 | Barr et al. ..... 175/73 |
| 5,582,258 | A | | 12/1996 | Tibbitts et al. |
| 5,651,420 | A | | 7/1997 | Tibbitts et al. |
| 5,901,797 | A | | 5/1999 | Hansen et al. |
| 5,967,246 | A | | 10/1999 | Caraway et al. |
| 6,006,846 | A | | 12/1999 | Tibbitts et al. |
| 6,065,554 | A | | 5/2000 | Taylor et al. |
| 6,302,223 | B1 | * | 10/2001 | Sinor ..... 175/393 |
| 6,328,117 | B1 | | 12/2001 | Berzas et al. |
| 7,036,611 | B2 | | 5/2006 | Radford et al. |
| 2005/0145417 | A1 | | 7/2005 | Radford et al. |
| 2006/0278441 | A1 | | 12/2006 | Cooley et al. |
| 2007/0079991 | A1 | | 4/2007 | Cooley et al. |

OTHER PUBLICATIONS

*International Search Report*, dated Oct. 23, 2008, PCT/US2008/05081.

* cited by examiner

METHODS AND APPARATUS FOR CONTROLLING CUTTING RIBBONS DURING A DRILLING OPERATION

CROSS REFERENCE TO RELATED APPLICATIONS

This application is the U.S. National Stage Application under 35 U.S.C. 371 of International Application No. PCT/US2008/05081, filed on 21 Apr. 2008, which claims the benefit of U.S. Provisional Application No. 60/934,324, filed 13 Jun. 2007.

BACKGROUND

1. Field

The present invention relates to the field of drill bits. More specifically, the present invention relates to fixed-cutter, rotary-type bits for use in the drilling of subsurface wells.

2. Background

Fixed-cutter, rotary-type bits are known in the field of subsurface drilling. Such drill bits are typically comprised of a bit body having a shank for connection to a drill string. The bit body is typically cast and/or machined from a metal material, such as steel. Alternatively, the bit body may be formed of a powdered metal such as tungsten carbide infiltrated at high temperatures with a liquefied binder material to form a matrix. In either instance, the shank encompasses an inner channel for supplying drilling fluid to the face of the bit through nozzles or other openings.

Different designs and types of fixed-cutter, rotary bits are employed by the drilling industry. Two common types of fixed-cutter bits are diamond impregnated bits and polycrystalline diamond compact ("PDC") bits. A diamond impregnated drill bit uses particulate diamonds, or "diamond grit," impregnated in a supporting metal matrix. In the drilling process the diamond particles cut the rock. A PDC bit uses PDC cutters to shear rock with a scraping motion. In either instance, the bit body is usually divided into blades, with cutting elements being mounted onto the individual blades.

In use, the drill bit is mounted onto the lower end of a drill string. The drill bit is rotated either by rotating the drill string at the surface, or by the actuation of downhole motors or turbines. In some instances, both methods may be used. During rotation of the drill bit, weight is applied to the bit. As the bit rotates with applied weight (referred to as "weight-on-bit," or "WOB"), the cutting elements are pressed against the formation. The rotating drill bit engages the rock formation and proceeds to form a borehole along a predetermined path toward a target zone.

The spaces formed between the drill blades are normally referred to as "junk slots." Drilling fluid passes through the inter-blade space, or junk slots, and carries the rock chips generated during drilling up the wellbore.

In brittle formations, the chips break into small pieces which are easily transported by the drilling fluid up the wellbore. However, in plastic formations, such as shales or highly pressurized mudstones and siltstones, the chips tend to adhere to each other and to the bit surface. These cuttings may form long ribbons of reconstituted material which are difficult to remove. In addition, the cutting ribbons lead to packing of the junk slots, resulting in a condition sometimes referred to as "bit balling". Bit balling leads to inefficient operation of the bit since the cutting structure of the bit is covered with previously drilled material. In addition, packing off of the junk slots prevents efficient transport of the cuttings out of the hole.

Of particular concern, cuttings generated while drilling shale formations with PDC bits and water-based mud have a tendency to form long ribbons of connected lamellae. These cutting ribbons lead to packing of the bit junk slots and bit balling. In some severe cases, the drill bit has to be pulled out of the hole and cleaned.

The problem of bit balling has been recognized by the industry. Various approaches have been attempted to mitigate the problem and promote the removal of cuttings. Generally, the approaches can be divided into two groups: hydraulic and mechanical.

Various patents have been issued addressing the hydraulic removal of formation cuttings. These include U.S. Pat. No. 4,606,418; U.S. Pat. No. 4,852,671; U.S. Pat. No. 5,172,778; U.S. Pat. No. 4,883,132; U.S. Pat. No. 4,913,244; GB Patent No. 2,085,945; and U.S. Pat. No. 5,115,873. These patents generally employ fluid discharge ports or fluid passages strategically placed in or between the cutter elements. The ports or passages allow the drilling fluid to cool the cutting elements and to remove the generated rock cuttings as the drilling fluid is circulated down the drill string and back up the annulus.

Various patents have also been issued addressing mechanical means for preventing cuttings accumulation, and facilitating the removal of any accumulated cuttings. These include U.S. Pat. No. 4,984,642; GB Patent No. 2,361,018; U.S. Pat. No. 5,582,258; and U.S. Pat. No. 5,447,208. U.S. Pat. No. 4,984,642 describes PDC cutters with surface corrugations for promoting chip break-up. GB Patent No. 2,361,018 discloses protrusions in the junk slots of the bit that act as chip breakers. U.S. Pat. No. 5,582,258 describes a chip breaking mechanism that imparts strain on the chip by bending and/or twisting the chip. U.S. Pat. No. 5,447,208 employs polished PDC cutting elements to provide a low-friction planar surface to reduce chip adhesion.

U.S. Pat. Nos. 5,651,420 and 5,901,797 are related patents that are directed to mechanical means attempting to reduce cuttings accumulations. These two patents provide mechanical flails disposed on various surfaces of the drill bit. The flails are tethered to the bit and some are driven by nozzles directing streams of drilling fluid in the direction of the flails. In some implementations, it is believed that these mechanical flails would become surrounded and effectively immobilized by the cuttings accumulating and balling around the flails themselves. Additionally, these patents describe bits having movable structures in an internal cavity. The drill bits are designed such that the cuttings pass through the internal cavity and are contacted by the driven structures in this internal cavity. While not clear from the descriptions of these patents, it is believed that the cavities are internal to the drill bit, such as in the axial region of the drill bit, as compared to the junk slots that are external to the bit body and disposed between the blades. It appears that this solution to bit balling in the junk slots attempted to open a portion of the junk slots to an internal cavity in which rotating vanes were believed to break the cuttings and send the broken cuttings back out of the cavity to flow through the wellbore annulus to the surface. The fluid flow of the drilling fluids and the cuttings into and out of the cavity is not made clear in the description of these patents but is believed to require a tortuous path, which is believed to introduce greater opportunities for accumulation of cuttings. These patents appear to rely upon the tethered flails to prevent such accumulations, but with the increased contacts with bit surfaces and edges, the effectiveness of such flails is questioned.

A need exists for an improved fixed cutter, rotary-type drill bit design.

SUMMARY

Drill bits are disclosed herein. The drill bits include a plurality of blades having cutting elements disposed therealong. Junk slots are formed between the respective blades. In addition, a knife opening is provided in at least two of the junk slots. More preferably, a knife opening is provided in each of the junk slots.

The drill bit also includes one or more ribbon cutters. The ribbon cutters are designed to cyclically protrude through the respective knife openings. The ribbon cutters facilitate the fragmentation of cuttings ribbons moving upward through the junk slots during a drilling operation.

In some implementations, the knife openings are disposed substantially transverse to a longitudinal axis of the drill bit. For example, the knife openings may be disposed at an angle that is about 1° to 30° relative to transverse to a longitudinal axis of the drill bit. More preferably, the knife openings are disposed at an angle that is about 1° to 10° relative to transverse to a longitudinal axis of the drill bit.

Additionally or alternatively, some implementations may include knife openings that are disposed at an angle that is substantially transverse to the angle of the junk slots. Some drill bits include blades and associated junk slots that extend around the drill bit at an angle relative to the bit's longitudinal axis rather than longitudinally up the drill bit. Accordingly, rather than being transverse to the longitudinal axis of the drill bit, the knife openings may be disposed substantially transverse to the angle of the junk slots. For example, the knife openings may be disposed at an angle that is about 0° to 10° relative to transverse to a angle of the junk slot in which the opening is provided.

In some implementations, the ribbon cutters may be hydraulically powered. For example, the ribbon cutters may each be hydraulically powered via a turbine arrangement.

The ribbon cutters may be provided in a variety of configurations. In one aspect, each of the ribbon cutters comprises a rotating knife having one or more cutting edges that rotate through a respective knife opening. In this configuration, each junk slot receives a rotating knife. In another aspect, each of the one or more ribbon cutters is provided by a single rotating knife. In this instance, the rotating knife may define a plate and a plurality of teeth extending radially from the rotating plate, with the teeth being dimensioned to extend through the knife openings as the plate rotates. In some implementations, the rotating knife comprises at least two raised surfaces along the plate, with ports adjacent thereto for inducing rotational movement of the rotating knife in response to fluid pressure.

Additionally or alternatively, one or more of the ribbon cutters may comprise a plurality of indenters that reciprocate through the knife openings, with each junk slot having an indenter. For instance, each of the indenters may reciprocate in response to rotational movement of a corresponding cam, with each cam having at least one leading edge. Alternatively, each of the indenters may reciprocate in response to rotational movement of a single cam. In either instance, the cams preferably move in response to fluid pressure.

Methods for forming, or drilling, a subsurface wellbore, are also provided. In one aspect, the method includes the steps of providing a drill string, and then connecting a drill bit to a lower end of the drill string. The drill bit may be in accordance with any of the drill bit embodiments described above. Preferably, the one or more ribbon cutters moves within the respective knife openings in response to hydraulic pressure provided by injecting fluid into the drill string.

An exemplary implementation of the present methods provides a method for preventing bit balling due to packing off of cuttings ribbons within a junk slot of a drill bit. The exemplary method includes the steps of providing a drill string and connecting a drill bit to a lower end of the drill string. The drill bit comprises a plurality of blades having cutting elements disposed therealong and junk slots formed between the respective blades. The method also includes rotating the drill string and the connected drill bit within a wellbore while applying weight to the drill bit in order to generate a rate of penetration.

A fluid is injected into the drill string under pressure in order to generate a drilling fluid flow rate. During the drilling process, ribbons formed or beginning to form in the junk slots are cut in a direction that is substantially transverse to a longitudinal axis of the drill bit. In some implementations, the cuttings ribbons are cut into segments that are shorter than the length of the junk slots. The length of the ribbon segments may be controlled by controlling the weight on bit, the rate of penetration, and the rate at which the ribbon cutters reciprocatingly protrude through the knife openings.

In one aspect, the drill bit also includes a knife opening formed in at least two of the junk slots. The knife openings are disposed substantially transverse to a longitudinal axis of the drill bit. In addition, one or more ribbon cutters is provided. The ribbon cutters are designed to cyclically protrude through the respective knife openings in order to facilitate the fragmentation of cuttings ribbons moving upward through the junk slots during the drilling operation.

The ribbon cutters may be hydraulically powered. The ribbon cutters may comprise a rotating knife having one or more cutting edges that rotate through a respective knife opening. In some implementations, each knife opening receives a rotating knife. The one or more ribbon cutters may comprise a single rotating knife defining a plate and a plurality of teeth extending radially from the rotating plate, with the teeth rotating through the knife openings. Alternatively, the ribbon cutters may comprise indenters that reciprocate through the knife openings.

BRIEF DESCRIPTION OF THE DRAWINGS

So that the manner in which the features of the present invention can be better understood, certain drawings, charts or graphs are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION

Definitions

As used herein, the term "blade" means a body on a drill bit having a cutting surface.

The term "junk slot" refers to any recessed area between blades on a drill bit.

The term "ribbon cutter" means any member used to cut, pierce, dissect, masticate or weaken formation cuttings traveling within a junk slot.

The term "ribbon" refers to any collection of formation material cut from a wellbore during drilling, and moving through or otherwise collected within a junk slot during a drilling operation.

Description of Selected Specific Embodiments

Figure 1:
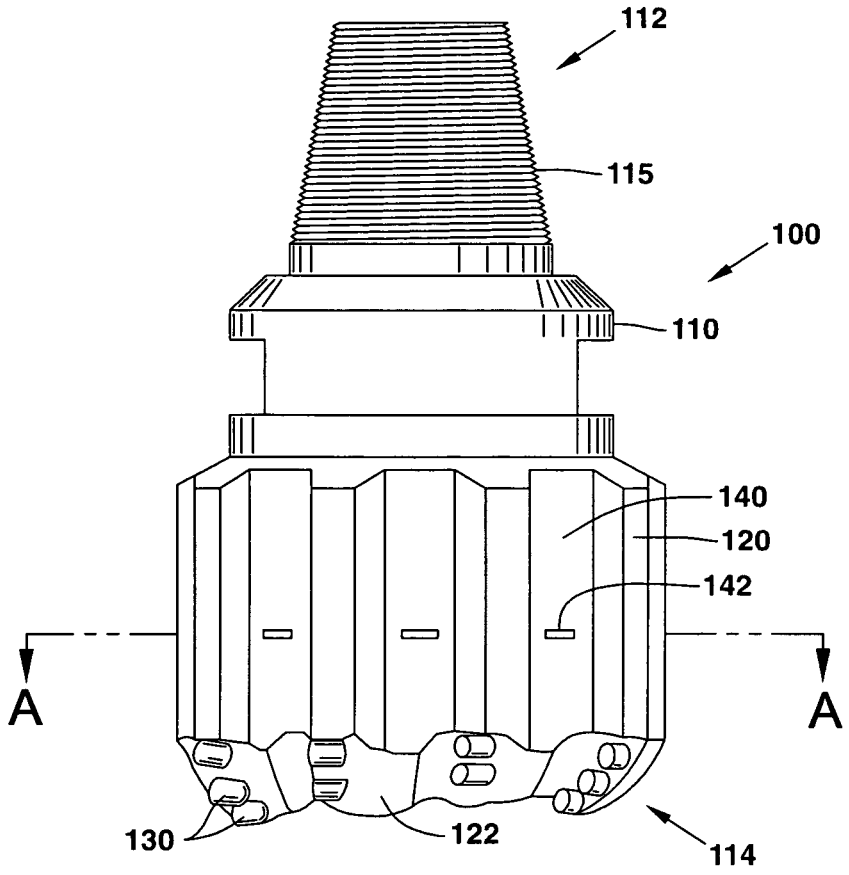
FIG. 1 is a side elevation view of a polycrystalline diamond compact ("PDC") drill bit.

FIG. 1 is a side elevation view of a polycrystalline diamond compact ("PDC") drill bit 100 in accordance with the present invention. Generally visible in this view are components of the PDC bit 100. As will be seen throughout this description, the principles of the present disclosure can be implemented in a variety of configurations and adapted for use with both conventional and forthcoming drill bits. The particulars features and elements illustrated in the accompanying Figures are for illustrative purposes only, particularly with respect to components of the drill bit that are not being modified or affected by the present disclosure, such as the connections to the drill string, etc.

As illustrated in FIG. 1, the drill bit 100 comprises a bit body, or "shank" 110. The shank 110 defines a generally tubular body having an upper end 112 and a lower end 114, referring the end regions rather than the actual terminus of the drill bit 100. The upper end 112 comprises a frusto-conical portion forming a threaded connector 115. The threaded connector 115 is used to attach the drill bit 100 to the bottom of a drill string (not shown). Alternatively, the threaded connector 115 may be attached to a rotary motor, a turbine, or other downhole rotary actuator (not shown). The upper end 112 may be configured in other manners suitable for coupling to a drill string.

Connected to or integral with the lower end 114 of the drill bit 100 is a plurality of blades 120. The blades 120 serve to engage a surrounding formation during a wellbore forming operation. In the configuration of FIG. 1 eight blades 120 are provided. As will be seen in the remaining figures and descriptions, the present systems and methods may be applied to drill bits having any number of blades having junk slots between the blades. The blades 120 are arranged radially around the bit 100 and extend outwardly from the lower end 114 of the shank 110. As the bit 100 is rotated, the blades 120 engage and cut away the rock formation.

Each of the blades 120 includes a series of cutting elements 130. The cutting elements 130 are disposed on a lower portion 122 of the blades 120. In the illustrative arrangement of FIG. 1, the lower portions 122 are beveled to form an inward angle. The lower portions 122 serve as a leading edge to engage the bottom of the formation as it is being drilled away. As is well known, the blades 120 may be configured in a variety of manners and the cutting elements may be disposed on the blades in a variety of configurations. Different configurations of blades and cutting elements are presently believed to be preferred for different applications and future configurations are likely to be developed going forward. The systems and methods of the present methods may be implemented in any or all of these configurations.

Each cutting element 130 may be a preformed cutting element brazed to a cylindrical carrier which is embedded or otherwise mounted in the lower portions 122 of the blades 120. The cutting elements 130 may be a preformed compact having a polycrystalline diamond front cutting table bonded to a tungsten carbide substrate, with the compact being brazed to a cylindrical tungsten carbide carrier (not shown). Alternatively, the substrate of each preformed PDC may be of sufficient axial length to be mounted directly in the lower portion 122 of the blade 120, so that the additional carrier may be omitted.

Figure 2:
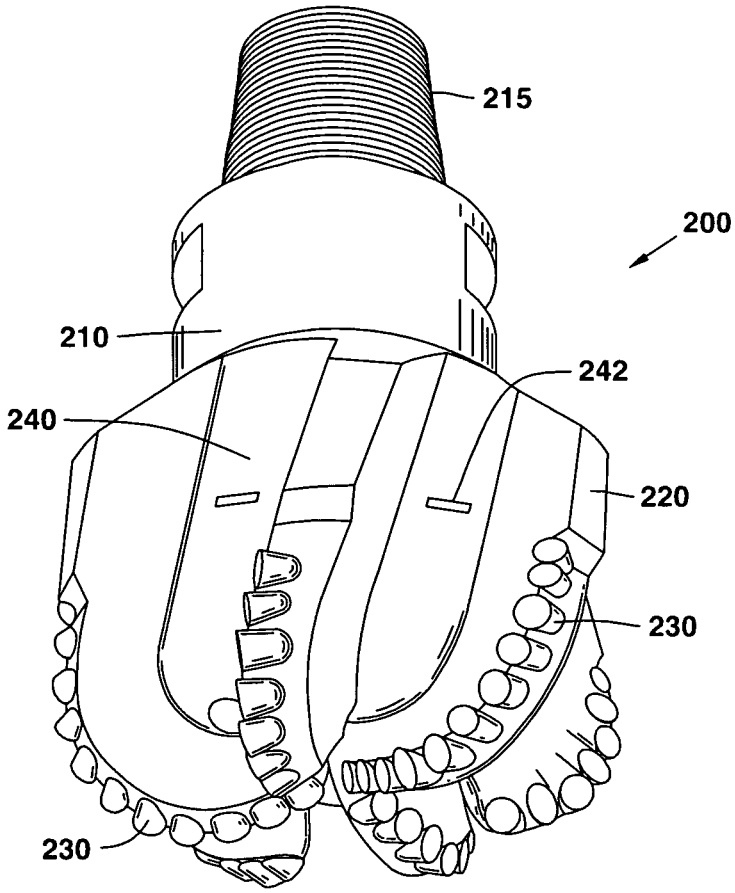
FIG. 2 is a perspective view of another polycrystalline diamond compact ("PDC") drill bit.
Figure 3:
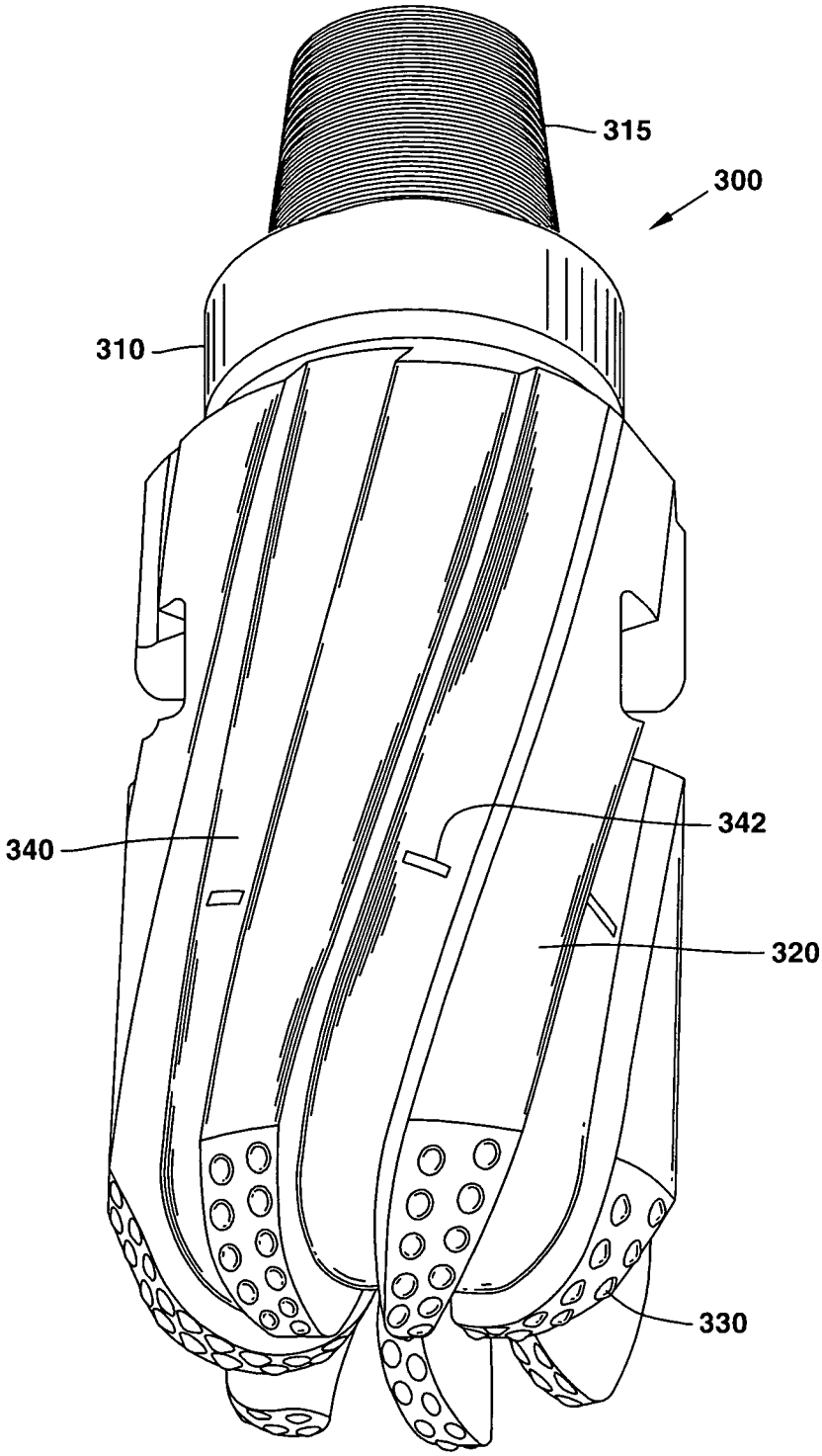
FIG. 3 is a perspective view of another polycrystalline diamond compact ("PDC") drill bit.

Disposed between the respective blades 120 are junk slots 140. In the implementation of FIG. 1, the junk slots 140 are formed by the relationship between two adjacent blades 120. FIGS. 2 and 3 illustrate that the junk slots 140 may be provided in a variety of configurations, including varied width, length, and orientation relative to the longitudinal axis of the drill bit. The junk slots 140 provide a fluid passage for drilling fluids as they are circulated from the bottom of the wellbore, around the drill bit 100, and upward towards the surface of the earth. The junk slots 140 further facilitate the circulation and removal of cuttings suspended in the drilling fluids.

Each junk slot 140 contains one or more knife openings 142. As will be described further below, the knife openings 142 are for the purpose of receiving a formation ribbon cutter (not seen in FIG. 1). In the arrangement of FIG. 1, the knife openings 142 are substantially horizontal. That is to say that with the longitudinal axis of the drill bit disposed vertically in the illustration, the knife openings 142 are illustrated horizontally on the page. In some implementations, the knife openings may be disposed substantially transverse to a longitudinal axis of the drill bit (i.e., horizontal in the illustration of FIG. 1). However, it is within the scope of the present invention to employ knife openings 142 that are angled relative to horizontal (or, relative to transverse to the longitudinal axis of the drill bit). In one aspect, the knife openings 142 are at an angle of about 0° to 30° relative to the transverse to the longitudinal axis of the drill bit. Alternatively, the knife openings 142 are at an angle of about 1° to 10° relative to the transverse to the longitudinal axis of the drill bit.

The knife openings 142 are dimensioned to receive ribbon cutters (not shown in this view). Preferably, a knife opening 142 and corresponding cutter are disposed in each junk slot 140. However, it is within the scope of the present invention to not have a knife opening 142 and corresponding ribbon cutter in each junk slot 140, but only in selected junk slots 140. Moreover, one or more junk slots may be provided with more than one knife opening. Similarly, while each knife opening may correspond to a given ribbon cutter, a single cutter may be configured to associate with multiple knife openings and/or multiple cutters may be associated with a given knife opening, as will be understood from the remaining figures and description.

It is noted here that when designing the bit 100 with the knife openings 142, care must be exercised not to compromise the integrity of the bit 100. This means that knife openings 142 notwithstanding, the bit 100 should be able to withstand the same loading (such as weight-on-bit) and torque, as a solid bit. Therefore, the knife openings 142 should preferably be sized to be as small as possible.

It is understood that the drill bit 100 in FIG. 1 is merely illustrative. The inventions as defined by the claims below may be embodied in other drill bit arrangements. FIGS. 2 and 3 provide examples of such other configurations. FIG. 2 demonstrates another PDC drill bit 200. This bit 200 similarly includes a bit body, or "shank" 210. The shank 210 defines a generally tubular body having a threaded connector 215. The drill bit 200 also has a plurality of blades 220 for engaging a surrounding formation during a wellbore forming operation. In the arrangement of FIG. 2 six blades 220 are provided. The blades 220 are arranged radially around the bit 200.

Each of the blades 220 once again includes a series of cutting elements 230. Each cutting element 230 defines hardened inserts such as synthetic diamond material bonded to a tungsten carbide substrate. Disposed between the respective blades 220 are junk slots 240. The junk slots 240 again provide a fluid passage for drilling fluids as they are circulated from the bottom of the wellbore, around the drill bit 200, and upward towards the surface of the earth. The junk slots 240 further facilitate the circulation and removal of cuttings suspended in the drilling fluids. In the arrangement of FIG. 2, the junk slots 240 create an angled path relative to the longitudinal axis of the drill bit. The angle generally travels away from the direction of rotation of the bit 200 during a drilling operation. It is believed that this facilitates the circulation of drilling fluids and cuttings away from the bottom of the wellbore. The particular angle of the junk slots, relative to the longitudinal axis and relative to the rotation of the bit may be varied depending on operator preferences and formation conditions.

As with bit 100 of FIG. 1, each junk slot 240 contains one or more knife openings 242. The knife openings 242 are disposed substantially transverse to a longitudinal axis of the drill bit 200. In one arrangement, the knife openings 242 are substantially horizontal. In another arrangement, the knife openings 242 are angled relative to horizontal at the same angle to be transverse to the angle of the junk slots 240. In either event, the knife openings 242 are dimensioned to receive ribbon cutters (not shown in this view).

FIG. 3 demonstrates another fixed-cutter, rotary-type bit 300 for use in the drilling of subsurface wells. However, unlike bits 100 and 200, bit 300 is a diamond impregnated bit. This bit 300 again includes a bit body, or "shank" 310. The shank 310 defines a generally tubular body having a threaded connector 315. The drill bit 300 also has a plurality of blades 320 for engaging a surrounding formation during a wellbore forming operation. In the arrangement of FIG. 3 seven blades 320 are provided. The blades 320 are arranged radially around the bit 300.

Disposed between the respective blades 320 are junk slots 340. The junk slots 340 again provide a fluid passage for drilling fluids as they are circulated from the bottom of the wellbore, around the drill bit 300, and upward towards the surface of the earth. The junk slots 340 further facilitate the circulation and removal of cuttings suspended in the drilling fluids. In the arrangement of FIG. 3, the junk slots 340 create an angled path. The angle preferably travels away from the direction of rotation of the bit 300 during a drilling operation.

As with bit 100 of FIG. 1, each junk slot 340 contains one or more knife openings 342. The knife openings 342 are disposed substantially transverse to a longitudinal axis of the drill bit 300. In one arrangement, the knife openings 342 are substantially horizontal. In another arrangement, the knife openings 342 are angled relative to horizontal at the same angle to be transverse to the angle of the junk slots 340. In either event, the knife openings 342 are dimensioned to receive ribbon cutters (not shown in this view).

Figure 4:
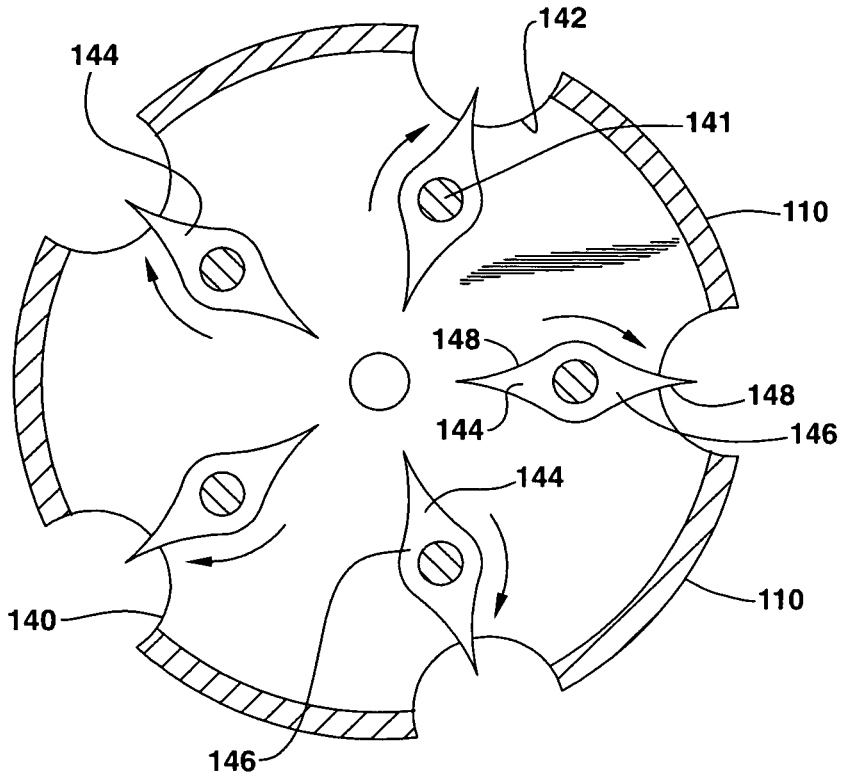
FIG. 4 is cross-sectional view of another drill bit, taken through the knife openings.

FIG. 4 shows a cross-section of a bit along the transverse direction, through the knife openings 142, such as along line A-A of FIG. 1. The bit may be any of bits 100, 200, 300, or any other rotary-type, fixed cutter bit. For purposes of discussion, the bit of FIG. 4 is numbered as bit 100 though the bit of FIG. 4 is obviously configured with five blades (provided in the region between junk slots 140) rather than the eight blades shown in FIG. 1. Thus, the knife openings are demonstrated at 142 and other components are numbered according to the illustration of FIG. 1 although the precise configurations may vary.

Adjacent each of the knife openings 142 is a ribbon cutter 144. One ribbon cutter 144 is disposed adjacent each of the junk slots 140 in the drill bit 100. In the illustrative embodiment of FIG. 4, five junk slots 140 are seen. Accordingly, five corresponding knife openings 142 are provided.

In this arrangement, each of the ribbon cutters 144 defines a knife 146. The knives 146 rotate through, or intermittently extend through, the knife openings 142 in the junk slots 140. A separate knife 146 rotates within each junk slot 140. The purpose of the rotating knife 146 is to cut, or at least weaken, the formation ribbons (not shown) generated during a drilling or wellbore forming process. The ribbons may be, for example, shale ribbons.

In one aspect, each of the knives 146 has one or more cutting edges 148. The cutting edges 148 rotate about a shaft 141 along a central axis. The shaft 141 is aligned parallel to a longitudinal axis of the drill bit. The cutting edges 148 rotate through the respective knife openings 142 in order to cut or score the ribbons in the junk slots 140. This creates a fragmentation of the ribbons, thereby inhibiting clogging or packing-off of the bit, which leads to bit balling.

Rotation of the knives 146 is preferably driven by a turbine arrangement inside the drill bit. The turbine arrangement (not shown in the drawings) is hydraulically powered by the drilling fluid as it is pumped down the drill string and through the drill bit. Other power sources known to those of ordinary skill in the art may be used to rotate the knives 146. The power source may be any suitable device such as a hydraulic source driven by fluid power or a battery-powered electric motor. Such downhole power sources are known to persons of ordinary skill in the art of drill tool design.

For drill bits having a larger number of junk slots 140, it may become impractical to outfit each of them with an autonomously powered knife. This is primarily due to space restrictions in the bit body 110, although manufacturing cost may also play a role. In such a case, it may be desirable to utilize a single rotating knife, as will be discussed below in connection with FIG. 5.

Figure 5:
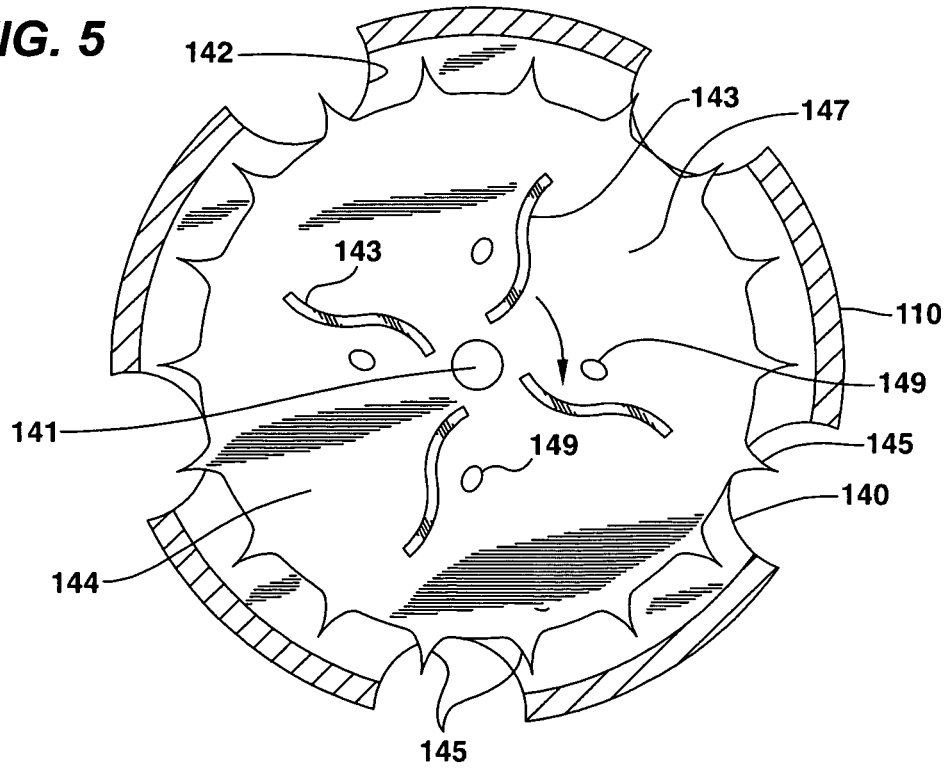
FIG. 5 is a cross-sectional view of another drill bit, taken through the knife openings.

FIG. 5 presents another cross-sectional view of a bit along the transverse direction. The view is again taken through knife openings, such as knife openings 142 of FIG. 1. Visible in this view is a single ribbon cutter 144 disposed within the body 110 of the bit. In the arrangement of FIG. 5, five junk slots 140 are seen. Each junk slot 140 is configured with a knife opening 142.

Rather than each junk slot 140 receiving a rotating knife 146 as in FIG. 4, a single rotating ribbon cutter 144 having a plurality of teeth 145 is used. The ribbon cutter 144 defines a central plate 147, wherein the teeth 145 reside radially about the plate. The teeth 145, in turn, extend through the knife openings 142. As the central plate 147 of the ribbon cutter 144 is rotated, the teeth 145 contact, and preferably cut, slice, or otherwise weaken, the ribbons of cuttings moving within the junk slots 140. The teeth 145, then, provide the same function as the knife 146 of FIG. 4. The ribbons may be, for example, shale ribbons.

In this configuration, the ribbon cutter 144 is also powered hydraulically. The ribbon cutter 144 rotates about a shaft 141 disposed centrally within the drill bit body 110. In one embodiment, the shaft 141 is coupled to a turbine (not shown) farther up the drill string. In another embodiment, the ribbon cutter 144 has a series of raised surfaces 143 adjacent to ports 149 through the central plate 147. As drilling fluid flows under pressure through the drill string, it encounters the central plate 147. Fluid acts against the raised surfaces 143. At the same time, openings or ports 149 may be provided to create a pressure differential. These features drive the ribbon cutter 144 to rotate within the drill bit body 110.

Figure 6:
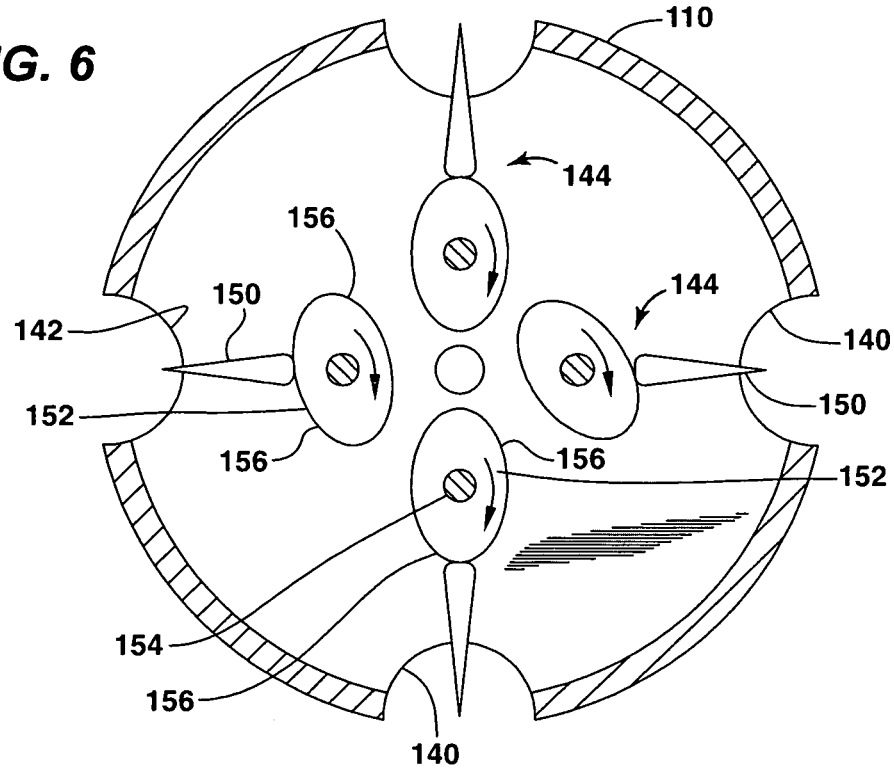
FIG. 6 is a cross-sectional view of another drill bit taken through the knife openings.
Figure 7:
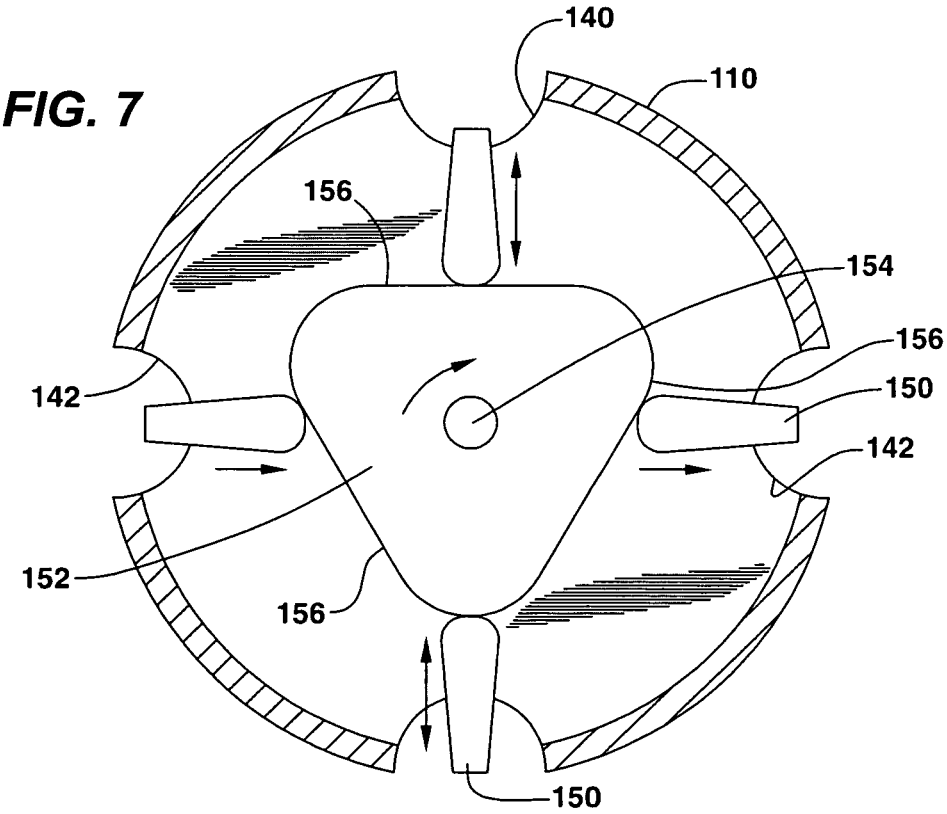
FIG. 7 is a cross-sectional view of another drill bit taken through the knife openings.

Other arrangements for ribbon cutters may be employed. FIG. 6 presents another cross-sectional view of a bit along the transverse direction. The view is again taken through knife openings within junk slots. The bit may be any of bits 100, 200, 300, or any other rotary-type, fixed cutter bit. Visible again in this view is a plurality of ribbon cutters 144 disposed radially around the bit. One ribbon cutter 144 is disposed adjacent each of the junk slots 140 in the drill bit 100. In the illustrative embodiment of FIG. 6, four junk slots 140 are seen. Accordingly, four corresponding knife openings 142 are provided. In this arrangement, each of the ribbon cutters 144 is configured as an "indenter" 150 rather than a "knife." The indenters 150 reciprocate in and out of the knife openings 142 in the junk slots 140 rather than rotating or sweeping through the knife opening as illustrated in FIGS. 4 and 5. While the reciprocating configurations of FIGS. 6 and 7 are denominated indenters, the indenters 150 may be provided with sharp edges designed to cut through the ribbons. In some implementations, the indenters 150 may be adapted to cut through the ribbons but may merely weaken the ribbon or perforate the ribbon rather than cut the ribbon, depending on the conditions in the wellbore. Factors such as the distance to which the indenter extends through the knife opening, the rate at which the indenter travels as it extends through the knife opening, and the wellbore conditions including ribbon properties may affect whether the ribbon is completely cut or is merely weakened or perforated to be broken under subsequent stresses in the wellbore. In the illustration of FIG. 6, a separate indenter 150 reciprocates within each junk slot 140.

The indenters 150 cyclically or reciprocatingly protrude through the knife openings 142. Each indenter 150 defines an elongated body having an end that protrudes through the respective knife openings 142. The indenters 150 do not stay in the knife openings 142, but rather reciprocate in and out. In this way, any ribbons moving through the junk slots 140 are diced into smaller lengths. In some implementations, the indenters 150 may include a sharp point 151, as in FIG. 6, which may be designed to poke through the ribbon. Other implementations of the ribbon cutters 144 may provide indenters of other configurations, including indenters that do not fully withdraw from the junk slot or indenters that have a blunt tip (as in FIG. 7) rather than the sharp point 151.

In the configuration illustrated in FIG. 6, the reciprocating movement of the various indenters 150 is driven by a corresponding rotating cam 152. This means that four cams 152 are used. Each of the cams 152 rotates about a shaft 154 that is parallel to a longitudinal axis of the bit. Different configurations may be provided for the cams 152. In the arrangement of FIG. 6, each cam 152 defines an oblong body. Thus, each of the rotating cams 152 has a pair of leading edges 156 that engage the respective indenters 150 as the cam 152 is rotated. When a leading edge 156 of the cam 152 engages an indenter 150, the indenter 150 is urged outwardly through the adjacent knife opening 142. The indenter 150 cuts through any ribbons that might be transported by the drilling fluid in the junk slot 140. Then, as the leading edge 156 of the cam 152 moves past the indenter 150, the indenter 150 returns to its biased position internal to the bit body 110. The indenters 150 may be biased to withdraw from the junk slot in any suitable manner, several of which will be apparent to one of skill in the art. Similarly, the indenters 150 may be secured in the bit body while allowing reciprocating motion as described in any suitable manner, several of which will be apparent to one of skill in the art. Due to the variety of drill bit configurations in which the present indenters and associated systems and methods may be implemented, the various means for reciprocatingly coupling the indenters to the drill bit are numerous. As just one example, the drill bit body may be provided with a post adjacent the knife openings 142 and the indenters may be provided with a slot on one surface. The slot in the indenter and the post may each be configured and associated to allow sliding movement of the indenter along the post while preventing the indenter from separating from the post. Continuing with this exemplary configuration, a biasing means may be associated with the slot and the post to withdraw the indenter from the junk slot in the reciprocating manner herein described.

Preferably, the rotating cams 152 are each powered hydraulically in response to circulation of the drilling fluid, such as through a turbine. The indenters 150 are biased towards an inward position. In this position, the indenters 150 do not protrude through the knife openings 142. However, the indenters 150 do not stay in the knife openings 142, but rather reciprocate in and out of the knife openings 142 in response to movement of the turbine. In this way, any ribbons moving through the junk slots 120 are diced into smaller lengths. Alternatively, the ribbons are at least indented to facilitate fragmentation.

FIG. 7 presents another cross-sectional view of a bit along the transverse direction. The view is again taken through knife openings 142. Visible again in this view is a plurality of ribbon cutters 144 disposed within the body 110 of the bit. Each ribbon cutter 144 again comprises an indenter 150. The indenters 150 protrude through the knife openings 142. Each indenter 150 defines an elongated body having an end that protrudes through a respective knife opening 142. Each indenter 150 resides adjacent a knife opening 142 in a junk slot 140. In the configuration of FIG. 7, four junk slots 140 are seen. Therefore, four indenters 150 are provided. However, it is within the scope of the present inventions to use a greater (or lesser) number of junk slots 140 and corresponding knife openings 142 and ribbon cutters 144.

Rather than each indenter 150 rotating in response to a corresponding cam 152 as in FIG. 6, a single rotating cam 152 is used. The rotating cam 152 rotates about a shaft 154. The shaft 154 is disposed along a central axis of the bit. The reciprocating movement of the various indenters 150 is driven by the single rotating cam 152. The illustrative cam 152 in FIG. 7 is triangular, providing three leading edges 156. The leading edges 156 engage the respective indenters 150 as the cam 152 is rotated. The configuration of the cam 152 may change with the configuration of the drill bit. For example, a drill bit having eight blades, eight junk slots, eight knife openings, and eight indenters may require a cam having more than three sides and three leading edges to appropriately drive the indenters. The cam configuration and number of indenters may be adapted to suite the particular drill bit and/or the particular drilling operation.

The indenters 150 are biased towards an inward position. In this position, the indenters 150 do not protrude through the knife openings 142. However, when a leading edge 156 of the cam 152 engages an indenter 150, the indenter 150 is urged outwardly through the corresponding knife opening 142. The indenters 150 cut through any ribbons that might be transported by the drilling fluid in the various junk slots 140. As the leading edge 156 of the cam 152 moves past the indenters 150, the indenters 150 return to their biased position internal to the bit body 110.

Preferably, the rotating cam 152 is powered hydraulically in response to circulation of the drilling fluid. As noted, the cam 152 rotates about a shaft 154 disposed centrally within the drill bit body 110. In one embodiment, the shaft 154 is coupled to a turbine farther up the drill string. In another embodiment, the cam 152 has a series of raised surfaces adjacent to ports through the cam 152. As drilling fluid flows under pressure through the drill string, it encounters the cam 152. Fluid acts against the raised surfaces and drives the cam 152 to rotate within the drill bit.

As can be seen, an improved drill bit is offered that mitigates bit balling due to the formation of ribbon cuttings, such as long shale ribbons. In the present embodiments, various active mechanisms are offered to produce a fragmentation of ribbons forming in the junk slots. The active cutting mechanisms consist of one or more ribbon cutters that are hydraulically powered by the drilling fluid. The ribbon cutters cyclically protrude through openings in the junk slots of the bit. As the ribbons formed of shale cuttings travel through the junk slots, the ribbon cutters cut through the ribbons. Thus, a shale ribbon may be broken into shorter segments that are easier to clean or circulate out.

Methods for mitigating bit balling due to the formation of long shale ribbons are also provided herein. In one aspect, the method includes the steps of providing a drill string and connecting a drill bit to a lower end of the drill string. The drill bit is in accordance with any of the embodiments of a drill bit described above. In this respect, the drill bit includes, generally, a plurality of blades having cutting elements disposed therealong; junk slots formed between the respective blades; a knife opening formed in at least two of the junk slots; and one or more ribbon cutters designed to cyclically protrude through the respective knife openings in order to facilitate the fragmentation of cuttings ribbons moving upward through the junk slots during a drilling operation.

The method also includes the step of injecting a fluid into the drill string under pressure. Preferably, the one or more ribbon cutters moves within the respective junk slots in response to hydraulic pressure provided by the step of injecting fluid into the drill string.

In one aspect, the proposed method for preventing bit balling is based on mechanically cutting ribbons in a direction that is substantially transverse to the length of the drill bit, and using an active or driven cutting mechanism. Preferably, ribbon cutters, i.e., knives or indenters, serve as the active cutting mechanism. The ribbon cutters are hydraulically actuated in response to fluid pressure within the drill string.

In operation, it is preferred that the formation ribbons be cut into pieces that are shorter than the length of the junk slots of the bit. To accomplish this, the hydraulic mechanism powering the ribbon cutters should be designed by taking into account the expected rate of penetration (ROP) and the drilling fluid flow rate. Those of ordinary skill in the art will understand that the cuttings travel time along the junk slot is determined by the ROP and the drilling fluid flow rate. Thus, the time between the successive cuts and/or indentations of a shale ribbon will preferably be less than the time it takes the cuttings to travel through the length of a junk slot.

The time between successive cuts and/or indentations is determined by the rotating speed of the knife and/or cam or the reciprocation of an indenter. The cutting time may be used as a design parameter for the hydraulic powering system. The cutting time should preferably be designed to provide a cut or indentation of the ribbons that is shorter than the time it takes the ribbon to travel through a junk slot. More preferably, the cyclical cutting time is one-fifth to one-third of the time that it takes a ribbon to travel through a junk slot.

While it will be apparent that the invention herein described is well calculated to achieve the benefits and advantages set forth above, it will be appreciated that the invention is susceptible to modification, variation and change without departing from the spirit thereof.

What is claimed is:

1. A drill bit, comprising:

a plurality of blades having cutting elements disposed therealong;

junk slots between the respective blades;

a knife opening in at least two of the junk slots; and one or more ribbon cutters designed to rotate eccentrically with respect to a drill bit rotational axis and protrude through the respective knife openings in order to facilitate the fragmentation of cuttings ribbons moving upward through the junk slots during a drilling.

2. The drill bit of claim 1, wherein the knife openings are disposed substantially transverse to a longitudinal axis of the drill bit.

3. The drill bit of claim 2, wherein the knife openings are disposed at an angle that is about 0° to 30° relative to transverse to a longitudinal axis of the drill bit.

4. The drill bit of claim 2, wherein the knife openings are disposed at an angle that is about 0° to 10° relative to transverse to a longitudinal axis of the drill bit.

5. The drill bit of claim 1, wherein the knife openings are disposed at an angle that is substantially transverse to the angle of the junk slots.

6. The drill bit of claim 5, wherein the junk slots are disposed at an angle that is about 1° to 10° relative to transverse to a longitudinal axis of the drill bit.

7. The drill bit of claim 1, wherein each of the ribbon cutters is hydraulically powered.

8. The drill bit of claim 7, wherein the ribbon cutters are each hydraulically powered via a turbine arrangement.

9. The drill bit of claim 1, wherein each junk slot comprises a knife opening.

10. The drill bit of claim 1, wherein each of the ribbon cutters comprises a rotating knife having one or more cutting edges that rotate through a knife opening, wherein a rotating knife is associated with each knife opening.

11. The drill bit of claim 1, wherein the one or more ribbon cutters comprises a single rotating knife defining a plate and a plurality of teeth extending radially from the rotating plate, wherein the teeth sweep through the knife openings as the plate rotates.

12. The drill bit of claim 11, wherein the rotating knife comprises at least two raised surfaces along the plate, with ports adjacent thereto, for inducing rotational movement of the rotating knife in response to fluid pressure.

13. The drill bit of claim 1, wherein each of the one or more ribbon cutters comprises an indenter that reciprocates through a knife opening, wherein an indenter is associated with each knife opening.

14. The drill bit of claim 13, wherein the indenters reciprocate in response to rotational movement of a corresponding cam, with each cam having at least one leading edge.

15. The drill bit of claim 13, wherein the indenters reciprocate in response to rotational movement of a single cam within the drill bit.

16. The drill bit of claim 15, wherein the single cam has three leading edges for engaging the indenters upon rotation.

17. The drill bit of claim 15, wherein the rotating cam has a shaft disposed along a central longitudinal axis of the drill bit.

18. The drill bit of claim 15, wherein the rotating cam comprises at least two raised surfaces, with ports adjacent thereto, for inducing rotational movement of the rotating cam in response to fluid pressure.

19. A method for forming a subsurface wellbore, comprising:

providing a drill string;

connecting a drill bit to a lower end of the drill string, the drill bit comprising:

a plurality of blades having cutting elements disposed therealong, junk slots between the respective blades, a knife opening in each of the junk slots, and one or more substantially rigid ribbon cutters designed to cyclically protrude a cutting edge through the respective knife openings to cut cuttings ribbons moving upward through the junk slots during a drilling operation; and injecting a fluid into the drill string under pressure.

20. The method of claim 19, wherein the one or more ribbon cutters moves within the respective knife openings in response to hydraulic pressure provided by injecting the fluid into the drill string.

21. The method of claim 19, wherein the knife openings are disposed substantially transverse to a longitudinal axis of the drill bit.

22. The method of claim 19, wherein the knife openings are disposed at an angle that is about 0° to 30° relative to transverse to a longitudinal axis of the drill bit.

23. The method of claim 19, wherein the knife openings are disposed at an angle that is about 1° to 10° relative to transverse to a longitudinal axis of the drill bit.

24. The method of claim 19, wherein the junk slots are disposed at an angle that is about 1° to 10° relative to transverse to a longitudinal axis of the drill bit.

25. The method of claim 24, wherein the knife openings are disposed at an angle that is substantially transverse to the angle of the junk slots.

26. The method of claim 19, wherein each of the ribbon cutters comprises a substantially rigid rotating knife having one or more cutting edges that rotates through a respective knife opening, wherein a rotating knife is associated with each knife opening.

27. The method of claim 26, wherein the rotating knives are each hydraulically powered via a turbine arrangement.

28. The method of claim 19, wherein the one or more ribbon cutters comprises a single rotating knife defining a plate and a plurality of teeth extending radially from the rotating plate, wherein the teeth sweep through the knife openings as the plate rotates.

29. The method of claim 28, wherein the rotating knife is hydraulically powered via a turbine arrangement.

30. The method of claim 29, wherein the rotating knife comprises at least two raised surfaces along the plate, with ports adjacent thereto, for inducing rotational movement of the rotating knife in response to fluid pressure.

31. The method of claim 19, wherein each of the one or more ribbon cutters comprises an indenter that reciprocates through a knife opening, wherein an indenter is associated with each knife opening.

32. The method of claim 31, wherein the indenters reciprocate in response to rotational movement of a corresponding cam, with each cam having at least one leading edge.

33. The method of claim 32, wherein each of the rotating cams is hydraulically powered via a turbine arrangement.

34. The method of claim 31, wherein the indenters reciprocate in response to rotational movement of a single cam within the drill bit.

35. The method of claim 34, wherein the single cam has three leading edges for engaging the indenters upon rotation.

36. The method of claim 35, wherein the rotating cam has a shaft disposed along a central longitudinal axis of the drill bit.

37. The method of claim 36, wherein the rotating cam comprises at least two raised surfaces, with ports adjacent thereto, for inducing rotational movement of the rotating cam in response to fluid pressure.

38. A method for preventing bit balling due to packing off of cuttings ribbons within a junk slot of a drill bit, comprising:

providing a drill string;

connecting a drill bit to a lower end of the drill string, the drill bit comprising a plurality of blades having cutting elements disposed therealong, a junk slot formed between the respective blades, at least one ribbon cutter designed to rotate eccentrically with respect to the drill bit rotational axis and cyclically protrude through a knife opening in the junk slot, while injecting a fluid into the drill string, the cutting elements producing cuttings ribbons within the junk slot;

rotating the drill string and the connected drill bit within a wellbore while applying weight to the drill bit to generate a rate of penetration;

injecting the fluid into the drill string under pressure to generate a drilling fluid flow rate and to cyclically protrude the at least one ribbon cutter through a knife opening; and rotating the plurality of blades to cut the cuttings ribbons in a direction that is substantially transverse to a longitudinal axis of the drill bit.

39. The method of claim 38, further comprising the step of cutting the ribbons into pieces that are shorter than the axial length of the junk slots slot.

40. The method of claim 39, further comprising the steps of:

providing at least two junk slots on the drill bit;

providing a knife opening in each of the at least two junk slots wherein each knife opening is disposed substantially transverse to a longitudinal axis of the drill bit; and cyclically protruding a ribbon cutter through each knife opening to cut the cuttings ribbons moving upward through each of the at least two junk slots during a drilling operation.

41. The method of claim 40, further comprising selecting the cyclical ribbon cutter protrusion frequency based at least in part on one or more of weight on bit, rate of penetration, and drilling fluid flow rate.

42. The method of claim 38, further comprising hydraulically powering each of the at least one ribbon cutters with the injected fluid.

43. The method of claim 38, further comprising providing a substantially rigid rotating knife as each of the at least one ribbon cutters, each of the substantially rigid rotating knives having one or more cutting edges that rotate through a respective knife opening, wherein a rotating knife is associated with each knife opening.

44. The method of claim 38, further comprising:

providing a substantially rigid rotating plate, the plate comprising at least one ribbon cutter associated therewith, wherein the at least one ribbon cutter comprises a plurality of teeth extending radially from the rotating plate; and sweeping the at least one ribbon cutter cyclically through the knife openings as the plate rotates.

* * * * *